US011325815B2

(12) United States Patent
Brzoska et al.

(10) Patent No.: US 11,325,815 B2
(45) Date of Patent: May 10, 2022

(54) TELESCOPIC BOOM AND MOBILE CRANE

(71) Applicant: LIEBHERR-WERK EHINGEN GMBH, Ehingen/Donau (DE)

(72) Inventors: Sebastian Brzoska, Ehingen (DE); Mario Helbig, Unterstation (DE)

(73) Assignee: LIEBHERR-WERK EHINGEN GMBH, Ehingen/Donau (DE)

( * ) Notice: Subject to any disclaimer, the term of this patent is extended or adjusted under 35 U.S.C. 154(b) by 100 days.

(21) Appl. No.: 16/831,030

(22) Filed: Mar. 26, 2020

(65) Prior Publication Data

US 2020/0307969 A1 Oct. 1, 2020

(30) Foreign Application Priority Data

Mar. 29, 2019 (DE) ..... 10 2019 108 286.2
Apr. 23, 2019 (DE) ..... 10 2019 110 505.6

(51) Int. Cl.
*B66C 23/82* (2006.01)
*B66C 23/70* (2006.01)

(52) U.S. Cl.
CPC ..... *B66C 23/82* (2013.01); *B66C 23/701* (2013.01)

(58) Field of Classification Search
CPC ..... B66C 23/54; B66C 23/64; B66C 23/66; B66C 23/701; B66C 23/82
See application file for complete search history.

(56) References Cited

U.S. PATENT DOCUMENTS 3,543,944 A * 12/1970 Uren ..... B66C 13/18 212/238
4,579,235 A * 4/1986 Orwig ..... B66C 23/82 212/180
2013/0048425 A1* 2/2013 Thompson ..... B66F 11/046 182/46
2014/0158657 A1* 6/2014 Knecht ..... B66C 23/36 212/299
2017/0238480 A1* 8/2017 Auvinen ..... B66C 23/54
2018/0258278 A1* 9/2018 Zia ..... B66C 23/701
2018/0327233 A1* 11/2018 Brzoska ..... B66C 23/64
2019/0106304 A1* 4/2019 Lissandre ..... B66C 15/06
2019/0106305 A1* 4/2019 Raymond ..... B66C 23/26

FOREIGN PATENT DOCUMENTS

DE 102017110412 A1 11/2018

* cited by examiner

*Primary Examiner* — Michael R Mansen
*Assistant Examiner* — Juan J Campos, Jr.
(74) *Attorney, Agent, or Firm* — McCoy Russell LLP

(57) ABSTRACT

The invention relates to a telescopic boom comprising a coupling section, on the side of which at least two luffing-cylinder mounts are provided for fastening luffing cylinders to the telescopic boom. The bearing plates of the luffing-cylinder mount transition into a metal-plate box structure, the metal-plate box structure being composed of three partial luffing-cylinder boxes.

11 Claims, 6 Drawing Sheets

TELESCOPIC BOOM AND MOBILE CRANE

CROSS-REFERENCE TO RELATED APPLICATIONS

The present application claims priority to German Patent Application No. 10 2019 108 286.2 filed on Mar. 29, 2019 and to German Patent Application No. 10 2019 110 505.6 filed on Apr. 23, 2019. The entire contents of each of the above-referenced applications are hereby incorporated by reference for all purposes.

TECHNICAL FIELD

The invention relates to a telescopic boom comprising a coupling section for a crane, in particular a mobile crane, on the side of which at least two luffing-cylinder mounts are provided for fastening luffing cylinders to the telescopic boom.

BACKGROUND AND SUMMARY

For example, DE 10 2017 110 412 A1 discloses a mobile crane in which a centrally arranged luffing cylinder can be bolted to the coupling section of the telescopic boom via a bolt mount. Load is transferred via the bolt mount into the lower shell of the boom profile, with a special metal-plate structure being provided here. While it is sufficient to provide a single centrally arranged luffing cylinder in many cranes, it is standard nowadays to use two luffing cylinders in large cranes.

FIGS. 1 and 2*a* show a corresponding conventional solution for mounting luffing cylinders in large cranes according to the prior art. The two luffing cylinders (not shown in greater detail here) luff the coupling section 1 via the self-contained luffing-cylinder box 3, which consists of a metal-plate structure, at the two force-introduction points 33 and thus luff the entire telescopic boom (only shown in part in the figure). The force-introduction points 33 are arranged in bearing plates, which transition into a metal-plate box structure for transferring load from the luffing-cylinder mount into the structure of the coupling section 1 of the telescopic boom. In the process, significant proportions of the force are introduced into the soft lower shell of the coupling section 1. A relatively tapered corner of the luffing-cylinder box 3 is formed at the connection between the cover plate 31 and lower shell of the coupling section 1 and the side plate 32. The corner denoted A in FIG. 1 may lead to problems at relevant moment angles, since the maximum permissible force transmission is limited by the luffing-cylinder box 3. The moment angle results from the permissible load, such as wind or the inclined position of the entire crane. If the metal-plate box structure is loaded to transfer load only in the luffing plane of the telescopic boom, the moment angle should be set to 0 degrees. If a disruptive force, such as wind, pushes the telescopic boom out of the luffing plane, the moment angle increases, and the entire telescopic boom is additionally loaded. If the moment angle is increased in such a manner, the above-mentioned tapered corner in region A proves to be problematic.

The problem addressed by the invention is to achieve a higher load-bearing capacity of the metal-plate box structure and the coupling section while also saving weight, which results in a higher load-carrying capacity of the entire boom. At the same time, the permissible load achieved is also intended to withstand disturbances, such as wind or an inclined position of the entire crane.

According to the invention, this problem is solved by the combination of features described in further detail below. Accordingly, two luffing-cylinder mounts, in particular bolt mounts, are provided on the side of a telescopic boom comprising a coupling section for fastening luffing cylinders to the telescopic boom. The bearing plates of the luffing-cylinder mount transition into a metal-plate box structure for transferring load from the luffing-cylinder mount into the structure of the telescopic boom. According to the invention, the metal-plate box structure is composed of three partial luffing-cylinder boxes, of which two partial luffing-cylinder boxes are arranged substantially below the side walls so as to be opposite one another in the lateral region of the lower shell in parallel with the coupling section, while a third partial luffing-cylinder box extends transversely to the coupling section.

The parallel partial luffing-cylinder boxes, which are oriented in parallel with the coupling section, are arranged such that they introduce the majority of the forces into the rigid profiled web walls of the coupling section. This takes place over the two lateral web plates of the partial luffing-cylinder box. The rigidity is further improved and therefore the load-bearing capacity is increased by the partial luffing-cylinder boxes extending transversely to the coupling section.

Preferred embodiments of the invention are found in the dependent claims, which are dependent on the main claim.

Particularly advantageously, the three partial luffing-cylinder boxes are each designed as closed box structures comprising two side walls, a cover plate and a corresponding end plate. The higher side plate of the partial luffing-cylinder boxes extending in parallel may also be composed of a plurality of partial plates.

Preferably, the third partial luffing-cylinder box, which extends transversely to the coupling section, adjoins each of the ends of the partial luffing-cylinder boxes which are opposite the end having the luffing-cylinder mounts. To increase the stability, this third partial luffing-cylinder box is welded to the partial luffing-cylinder box extending in parallel.

According to another preferred embodiment of the invention, the metal plates of the substantially parallel partial luffing-cylinder boxes may penetrate the metal plates of the third partial luffing-cylinder box at least in part. Therefore, a side plate or web plate of the relevant parallel partial luffing-cylinder box continues in the transversely extending partial luffing-cylinder box as an adjoining side plate or web plate. By welding this mutually penetrating plate structure together, particularly high stability is achieved.

Preferably, buckling struts formed on the lower shell of the coupling section may accordingly only extend as far as the partial luffing-cylinder box, which extends transversely to the coupling section. To increase the strength, the ends of the buckling struts may be welded to the partial luffing-cylinder box.

Lastly, according to another advantageous embodiment, an additional metal-plate box structure may interconnect the partial lulling-cylinder boxes, which are arranged in parallel with one another, below the lower shell of the coupling section. Here, an additional metal-plate box structure is therefore arranged substantially in parallel with the third partial luffing-cylinder box. Increased strength is also achieved here by welding to the two partial luffing-cylinder boxes extending in parallel with one another.

Particularly advantageously, the additional metal-plate box structure may be connected to the lower shell of the coupling section at least in part, advantageously likewise may be welded again, in the region between the two adjacent partial luffing-cylinder boxes to which it is welded. This connection is only indented into the lower shell to a negligible extent. Essentially, by means of this additional metal-plate box structure, the two luffing-cylinder mounts, which indeed constitute force-introduction points, are mutually reinforced. Furthermore, stabilizing forces can then also be absorbed by the lower shell perpendicularly to the longitudinal axis of the coupling section. The lower shell has a particularly high load capacity in this direction.

Lastly, the invention also relates to a crane, in particular a mobile crane, which comprises at least one telescopic boom having the above-mentioned features.

The metal-plate box structure according to the invention, which is formed by the three partial luffing-cylinder boxes, transfers a significant force into the coupling section. The outer part of the coupling section thus bends around the connection point to the metal-plate box structure. Here, it is particularly advantageous, by contrast with the solution according to the prior art discussed at the outset, for there not to be any tapered corners in the region of the lower shell, as these each constitute a region at risk of the plate buckling. Avoiding such tapering corner transitions thus increases the stability and improves the load-bearing capacity with a simultaneously comparatively low weight of the overall structure.

BRIEF DESCRIPTION OF THE FIGURES

Further features, details and advantages of the invention will become apparent from the following detailed description of a preferred embodiment, which is explained with reference to the accompanying drawings, in which.

DETAILED DESCRIPTION

Figure 1:
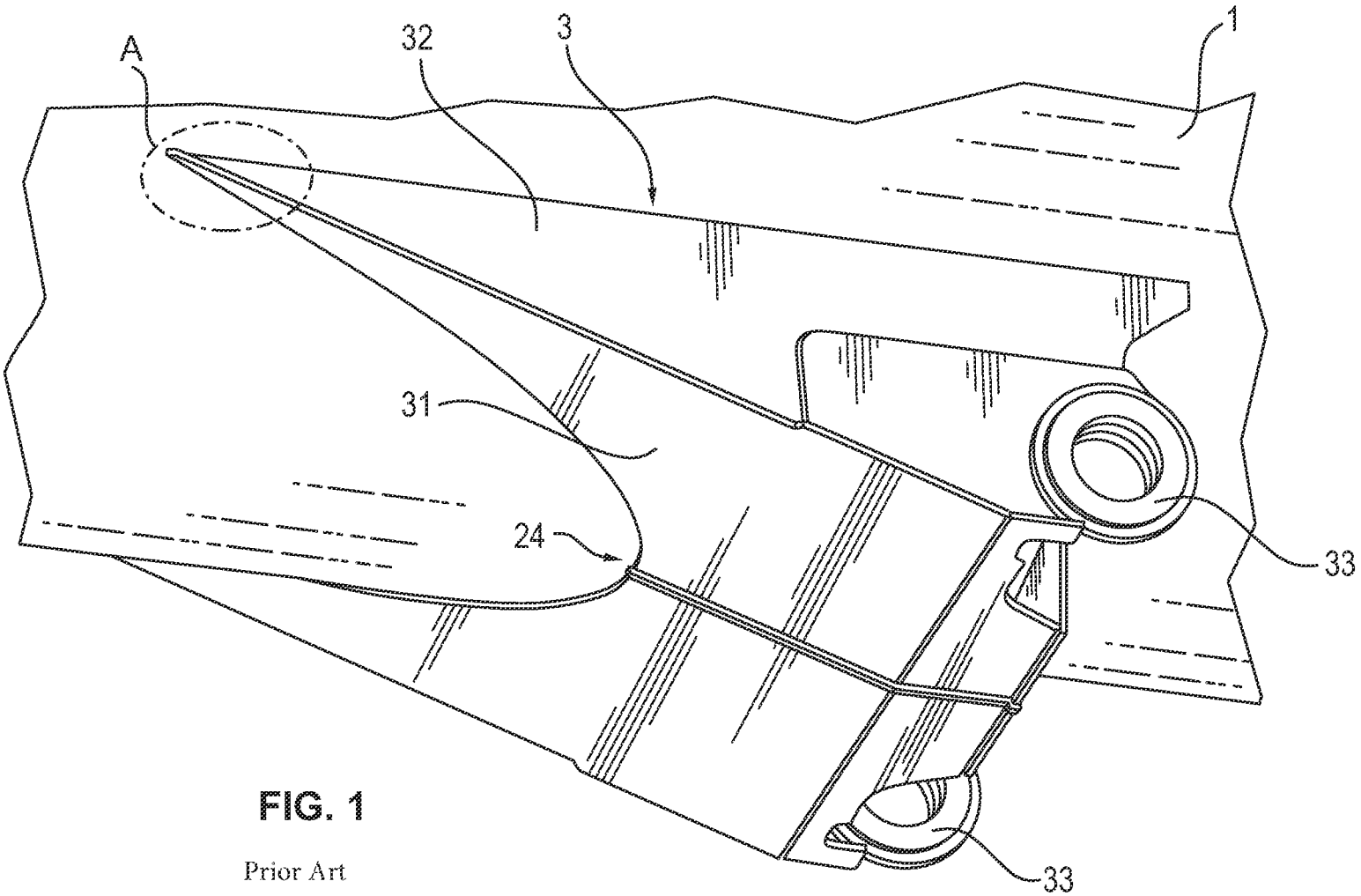
FIG. 1 Prior Art
FIG. 1 is a view of a detail of a telescopic boom according to the prior art.
Figure 2A:
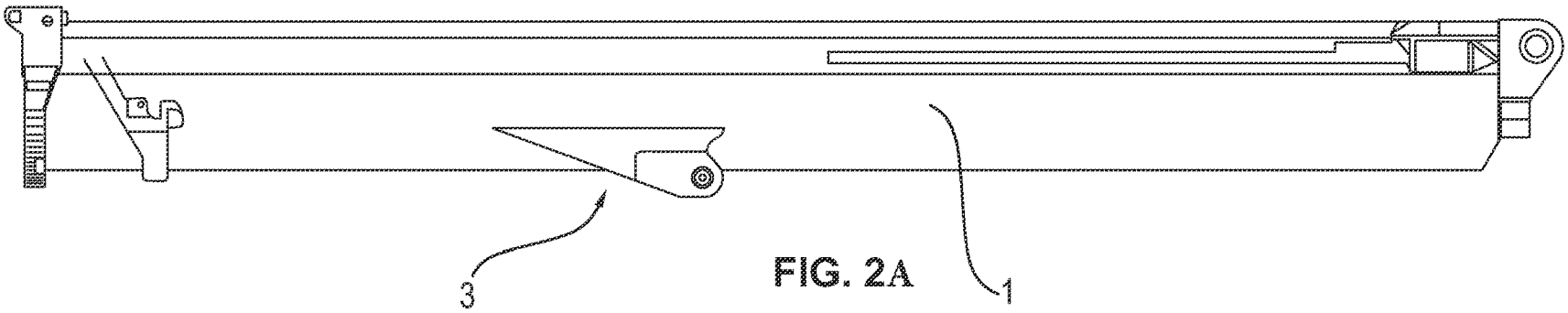
FIG. 2A Prior Art
FIG. 2A is a side view of the coupling section according to FIG. 1.
Figure 2B:
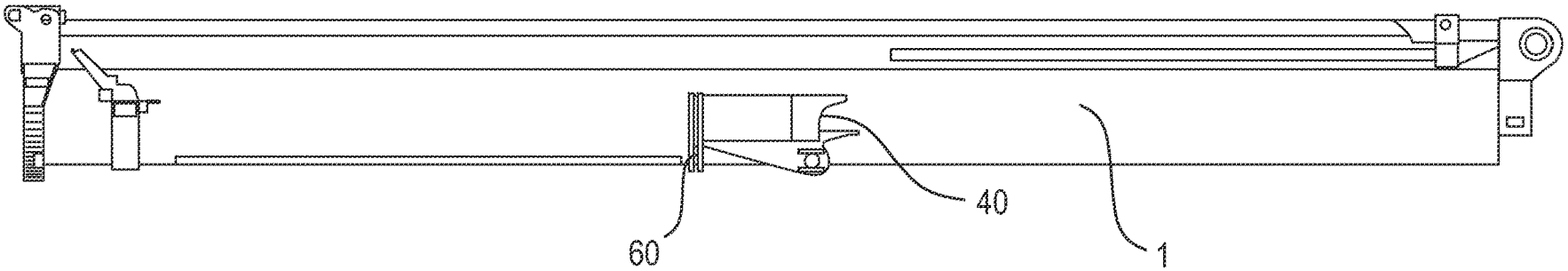
FIG. 2B is a side view of an embodiment of the coupling section according to the invention.

FIG. 2B shows a coupling section 1 of a telescopic boom according to an embodiment of the present invention. Here, lateral luffing-cylinder mounts 33 in the form of bolt mounts are provided as force-introduction points. Luffing cylinders (not shown in greater detail here), which, in a known manner, serve to move the telescopic boom up and down, are articulated to said luffing-cylinder mounts 33.

In the present case, corresponding luffing-cylinder mounts 33 are provided on each side, since this is a large crane. The bearing plates 71 of the luffing-cylinder mounts transition into a metal-plate box structure 3, which serves to transfer load from the luffing-cylinder mount 33 into the structure of the telescopic boom.

The more precise structure of the metal-plate box structure is explained with reference to FIGS. 3, 4, 5A, 5B and 6. Accordingly, the metal-plate box structure 3 is composed of three partial luffing-cylinder boxes 40, 50, 60, of which two partial luffing-cylinder boxes 40, 50 are arranged substantially below the side walls 11 so as to be opposite one another in the lateral region 72 of the lower shell 73 of the coupling section 1 in parallel with the coupling section 1 (cf. in particular FIG. 6).

Figure 3:
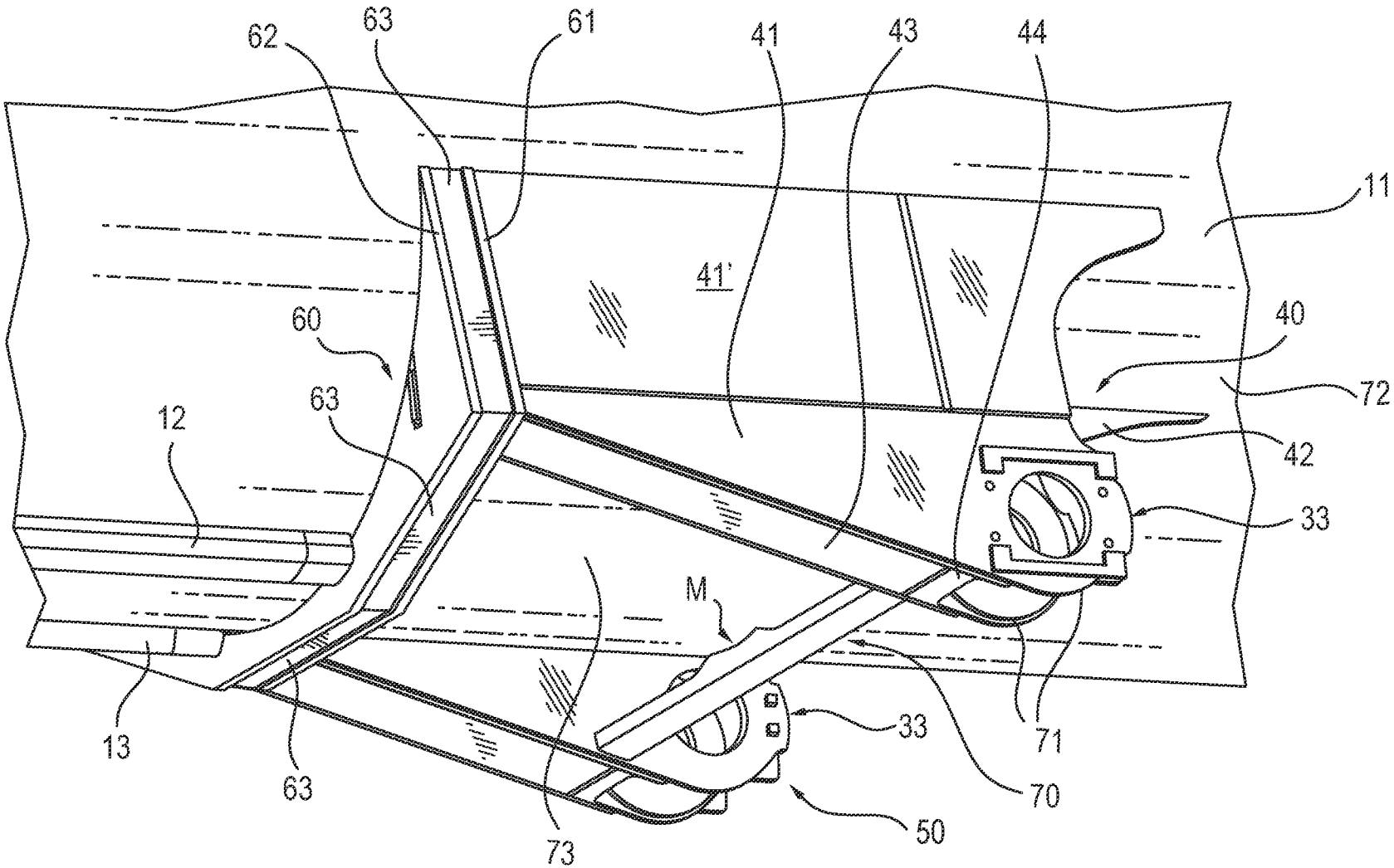
FIG. 3 is a perspective view of a detail of the coupling section.
Figure 4:
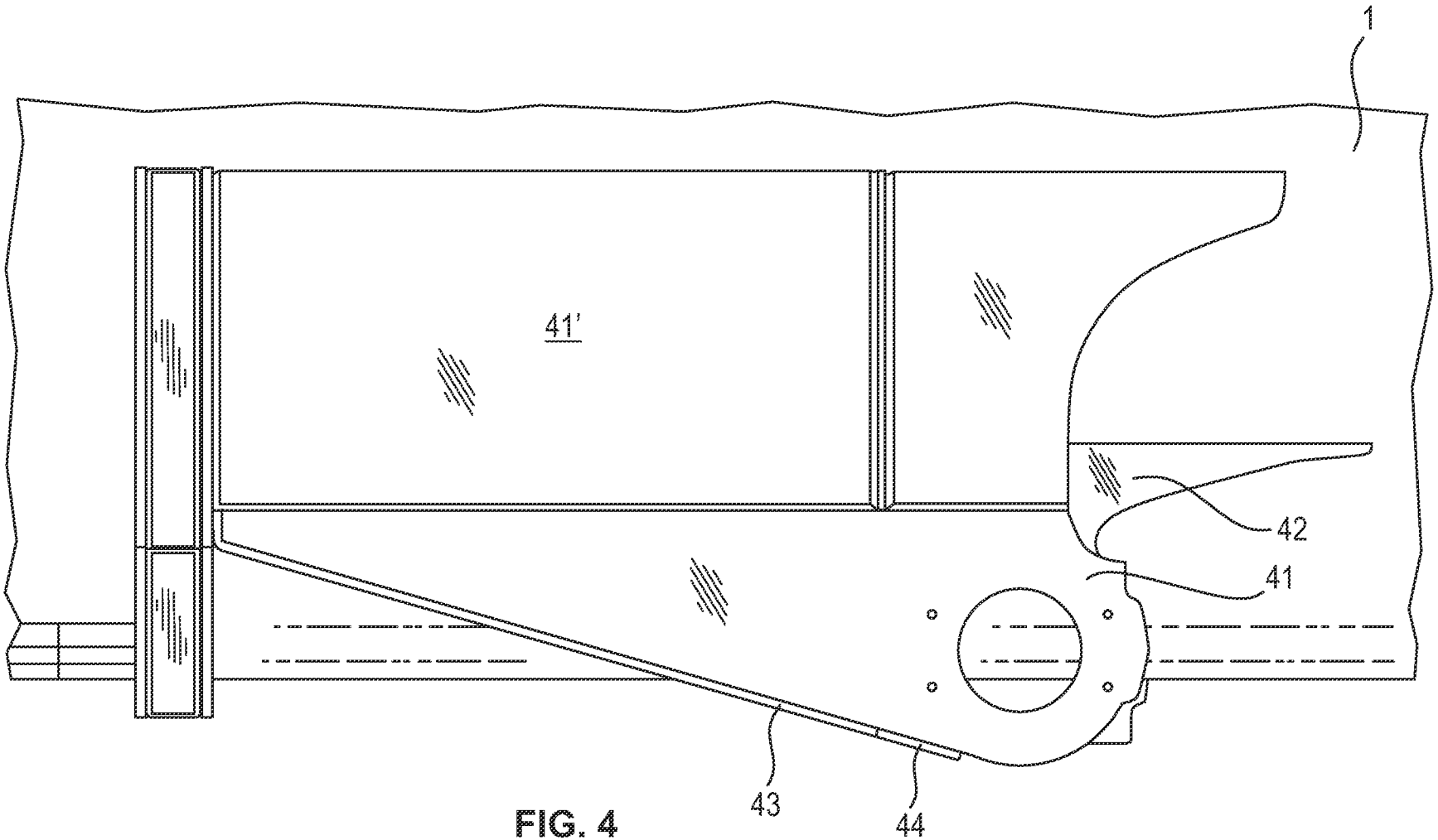
FIG. 4 is a side view of the detail of the coupling section according to FIG. 3.

Furthermore, a third partial luffing-cylinder box 60 is arranged transversely to the coupling section 1, as shown in FIG. 3, for example. The partial luffing-cylinder boxes 40, 50 introduce the majority of the forces into the rigid profiled web walls 11 of the coupling section 1. This takes place over the two web plates 41, 42 (cf. FIG. 3). Here, the higher plate, which extends to the outer wall, as shown here, may also consist of a plurality of partial plates 41, 41' (cf. FIG. 4). The two partial luffing-cylinder boxes 40, 50 constitute closed boxes and comprise cover plates 43, 44. Corresponding end plates 74 are also provided.

A partial luffing-cylinder box 60 extends transversely to the boom section 1. It also comprises web plates 61, 62. Cover plates 63 are also provided in order to produce a closed box structure here too.

Figure 5B:
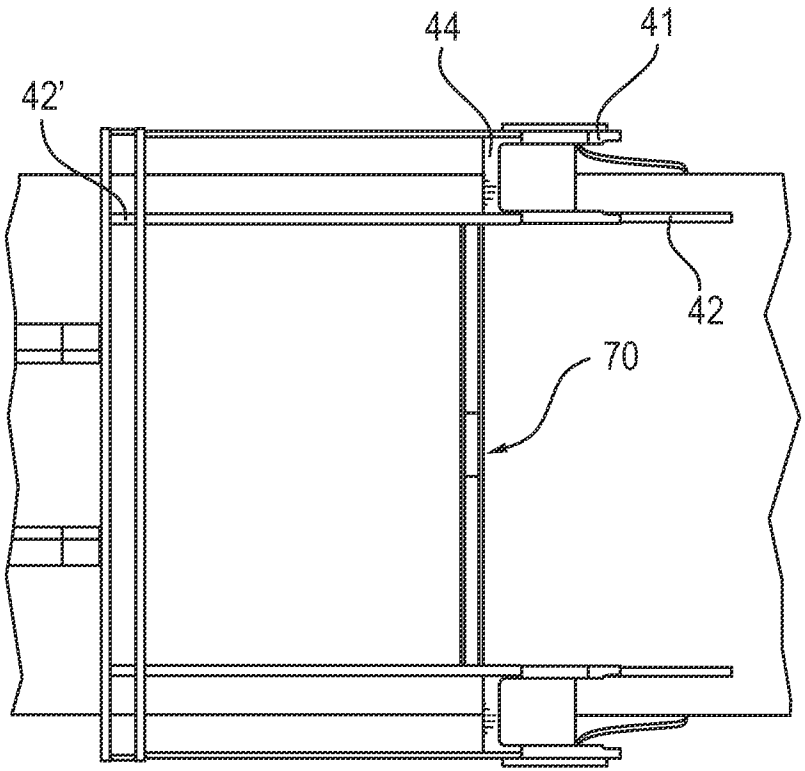
FIG. 5B is a view corresponding to FIG. 5A, with the cover plates of the partial luffing cylinders being omitted in part.
Figure 5A:
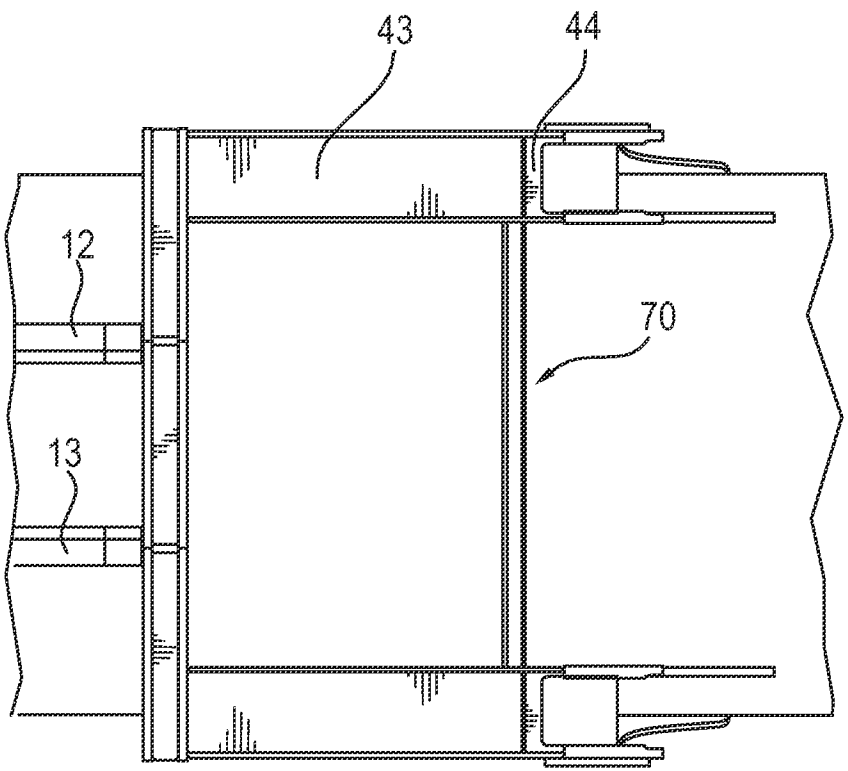
FIG. 5A is a view from below of the detail of the coupling section according to FIG. 3.

In FIG. 5B, most of the cover plates are hidden, such that it can be seen that the partial luffing-cylinder boxes 40, 60 penetrate the partial luffing-cylinder boxes 50, 60 in part. Therefore, after welding the two partial luffing-cylinder boxes 40 and 60, the web plate 42 continues in the partial luffing-cylinder box 60 by means of a web plate 42'.

FIG. 3 shows in detail that buckling struts 12, 13 that extend in parallel and are provided in the coupling section 1 end at the partial luffing-cylinder box 60 and are welded thereto. A continuing buckling strut 12, 13 in the region of the lulling-cylinder box is not necessary, since the box itself provides sufficient stability against buckling.

Figure 6:
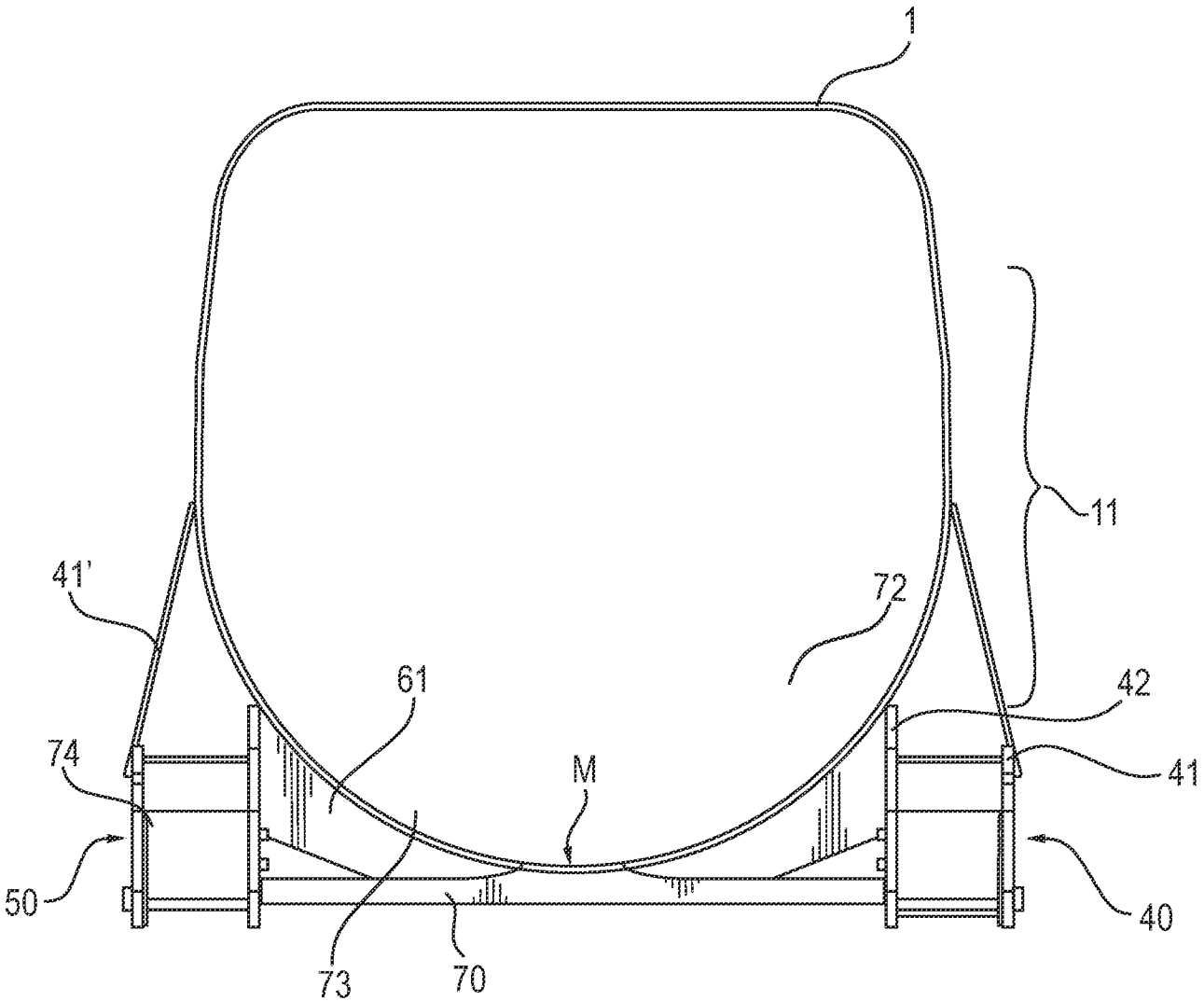
FIG. 6 is a front view of the view of a detail according to FIG. 3.

FIG. 3 and also FIG. 6 in particular show that another metal-plate box structure 70 is additionally provided as a stabilizing additional box. It is also a box-shaped metal-plate box structure which is completely closed. Side plates and cover plates are also provided. This metal-plate box structure 70 rigidifies the entire metal-plate box structure 3 and interconnects the two partial lulling-cylinder boxes 40, 50. In the center M, it is connected to the comparatively soft lower shell of the coupling section 1, which can be seen in FIG. 6. This connection is only indented into the lower shell to a negligible extent. Essentially, the two luffing-cylinder mounts 33, i.e. the force-introduction points, are braced against one another. Furthermore, stabilizing forces can also be absorbed by the lower shell perpendicularly to the longitudinal axis of the coupling section 1. The lower shell has a particularly high load capacity in this direction.

The invention claimed is:

1. A telescopic boom comprising a coupling section with at least two luffing-cylinder mounts for fastening luffing cylinders to the telescopic boom, wherein bearing plates of each luffing-cylinder mount transition into a metal-plate box structure for transferring load from each luffing-cylinder mount into of the telescopic boom, wherein the metal-plate box structure comprises three partial luffing-cylinder boxes, of which two partial luffing-cylinder boxes are arranged substantially below side walls so as to be opposite one another in a lateral region of a lower shell of the coupling section and parallel with the coupling section, while a third partial luffing-cylinder box extends transversely to the coupling section.

2. The telescopic boom according to claim 1, wherein the three partial luffing-cylinder boxes are each box structures comprising two side walls, a cover plate, and an end plate.

3. The telescopic boom according to claim 1, wherein the third partial luffing-cylinder box adjoins each end of the two partial luffing-cylinder boxes which are opposite an end having the at least two luffing-cylinder mounts.

4. The telescopic boom according to claim 3, wherein the third partial luffing-cylinder box is welded to the two partial luffing-cylinder boxes.

5. The telescopic boom according to claim 4, wherein metal plates of the two substantially parallel partial luffing-cylinder boxes penetrate metal plates of the third partial luffing-cylinder box at least in part.

6. The telescopic boom according to claim 1, wherein at least one buckling strut formed on the lower shell only extends as far as the third partial luffing-cylinder box, which extends transversely to the coupling section.

7. The telescopic boom according to claim 6, wherein the at least one buckling strut formed on the lower shell is welded to a partial luffing-cylinder box of the two partial luffing-cylinder boxes.

8. The telescopic boom according to claim 1, wherein an additional metal-plate box structure interconnects the two partial luffing-cylinder boxes, which are arranged in parallel with one another, below the lower shell.

9. The telescopic boom according to claim 8, wherein the additional metal-plate box structure is connected to the lower shell section in a center thereof between the two partial luffing-cylinder boxes adjacent thereto.

10. The telescopic boom of claim 1, wherein the at least two luffing-cylinder mounts are bolt mounts.

11. A crane or a mobile crane, comprising a telescopic boom, the telescopic boom comprising:

a coupling section, on a side of which at least two luffing-cylinder mounts are provided for fastening luffing cylinders to the telescopic boom, and bearing plates of each luffing-cylinder mount transition into a metal-plate box structure for transferring load from the respective luffing-cylinder mount into the telescopic boom, wherein the metal-plate box structure is composed of three partial luffing-cylinder boxes, of which two partial luffing-cylinder boxes are arranged substantially below side walls of the coupling section so as to be opposite one another in a lateral region of a lower shell in parallel with the coupling section, while a third partial luffing-cylinder box extends transversely to the coupling section.

* * * * *